US010226160B2

(12) United States Patent
Han et al.

(10) Patent No.: US 10,226,160 B2
(45) Date of Patent: Mar. 12, 2019

(54) DISHWASHER

(71) Applicant: LG ELECTRONICS INC., Seoul (KR)

(72) Inventors: Shinwoo Han, Seoul (KR); Joonho Pyo, Seoul (KR); Jaechul Lee, Seoul (KR); Daegyu Kim, Seoul (KR); Seyoung Woo, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 653 days.

(21) Appl. No.: 14/794,221

(22) Filed: Jul. 8, 2015

(65) Prior Publication Data

US 2016/0015241 A1 Jan. 21, 2016

(30) Foreign Application Priority Data

Jul. 16, 2014 (KR) ..... 10-2014-0089910

(51) Int. Cl.
*A47L 15/42* (2006.01)
*A47L 15/23* (2006.01)

(52) U.S. Cl.
CPC ..... *A47L 15/4282* (2013.01); *A47L 15/23* (2013.01); *A47L 15/4289* (2013.01)

(58) Field of Classification Search
None
See application file for complete search history.

(56) References Cited

U.S. PATENT DOCUMENTS 9,462,924 B2 * 10/2016 Pyo ..... A47L 15/23

FOREIGN PATENT DOCUMENTS

| | | |
|---|---|---|
| CN | 103371789 | 10/2013 |
| CN | 103654666 | 3/2014 |
| CN | 103654673 | 3/2014 |
| EP | 2 522 268 A1 | 11/2012 |
| EP | 2 656 772 A2 | 10/2013 |
| EP | 2 710 945 A1 | 3/2014 |
| EP | 2 710 946 A2 | 3/2014 |
| KR | 10-0943772 | 2/2010 |

OTHER PUBLICATIONS

Chinese Office Action dated Jun. 20, 2017 issued in Application No. 201510419720.6.
European Search Report dated Dec. 1, 2015 issued in Application No. 15176426.3.

* cited by examiner

*Primary Examiner* — Michael E Barr
*Assistant Examiner* — Jason P Riggleman
(74) *Attorney, Agent, or Firm* — Ked & Associates, LLP

(57) ABSTRACT

A dishwasher includes a cabinet having a tub, a pump and at least one spray arm. The at least one spray arm has a flow path guide and first and second flow channels separated from each other. The flow path guide has a first opening to allow wash water to flow to the first flow channel and a second opening to allow wash water to flow to the second flow channel. A valve is coupled to the flow path guide and is configured to open or close one of the first opening and the second opening. The valve includes a rotatable float. The rotatable float closes the first opening while opening the second opening at a first point in time, and the rotatable float rotates to open the second opening while closing the second opening at a second point in time.

18 Claims, 9 Drawing Sheets

(a)

(b)

DISHWASHER

CROSS-REFERENCE TO RELATED APPLICATION

This application claims priority to Korean Patent Application No. 10-2014-0089910 filed on Jul. 16, 2014 in Korea, whose entire disclosure is hereby incorporated by reference.

BACKGROUND

1. Field

Embodiments of the present disclosure relate to a dishwasher.

2. Background

Dishwashers are electric home appliances for washing contaminants such as scraps or leftover food on dishes or cookware (hereinafter, 'washing objects'), using washing-up liquid and washing water. A dishwasher usually includes a tub configured to provide a washing space, a dish rack provided in the tub to receive washing objects thereon, and a spraying arm for spraying washing water to the dish rack, a sump configured to store washing water therein and a supply path configured to supply the washing water stored in the sump to the spray arm.

When a user selects a washing course, the dishwasher having the structure mentioned above may take off and wash out food scraps or waste on washing objects through spraying the washing water to the washing objects held in the rack. After that, the dishwasher may dry the washing objects having had the scraps or waste washed out, using hot or heated air.

BRIEF DESCRIPTION OF THE DRAWINGS

Embodiments will be described in detail with reference to the following drawings in which like reference numerals refer to like elements, and wherein.

DETAILED DESCRIPTION

Figure 1:
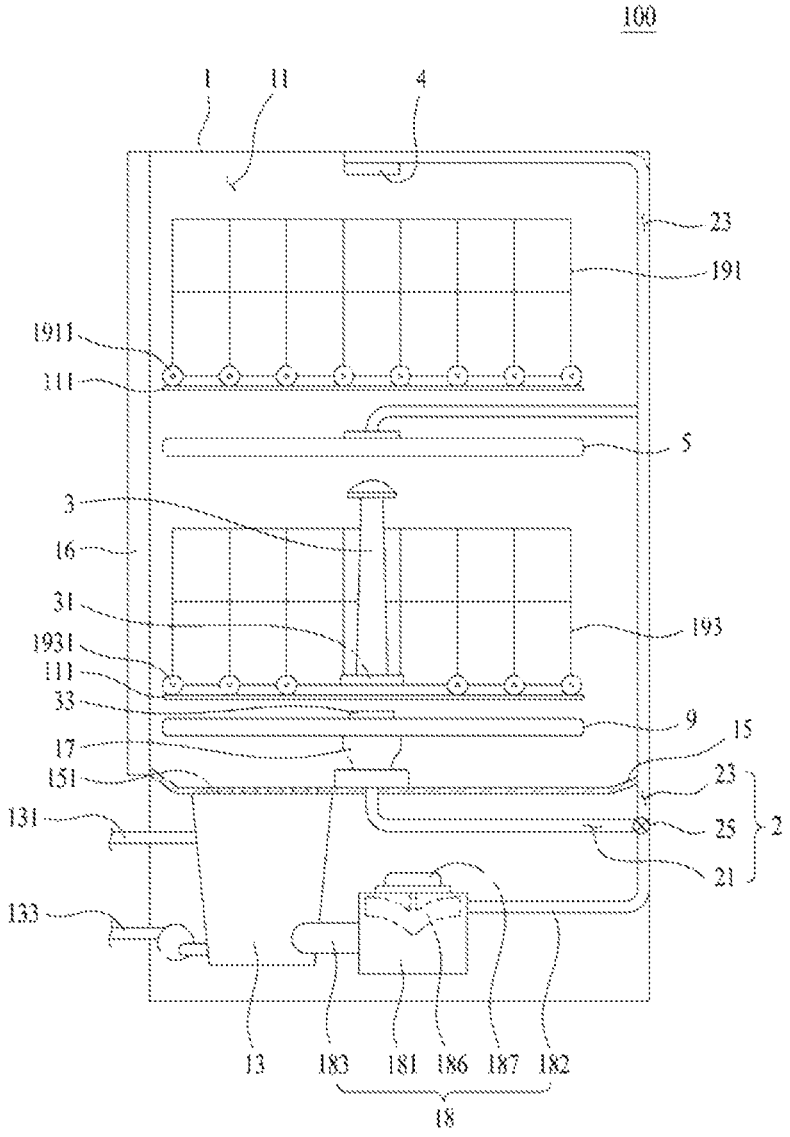
FIG. 1 is a diagram illustrating a basic structure of a dishwasher in accordance with exemplary embodiments of the present disclosure.

FIG. 1 is a diagram illustrating a basic structure of a dishwasher in accordance with exemplary embodiments of the present disclosure. The dishwasher includes a cabinet 1 configured to define an exterior appearance of the dishwasher 100; a tub 11 provided in the cabinet and configured to provide a washing space; a sump 13 to recirculate the washing water stored in the tub; a cover 15 provided above the sump to partition off the tub and the sump; and a door 16 coupled to the cabinet to open and close the washing space.

The sump 13 is provided with washing water via a sump water supply path 131 and the washing water supplied to the sump may be drained via a sump drainage path 133. The washing water sprayed into the tub 11 from spray arms 5 and 9 may be re-collected or recirculated in the sump 13 via a collecting hole 151 provided in the cover 15.

The tub 11 may include racks on which washing objects (e.g., dishes) are placed. The racks include a first rack 191 and a second rack 193 provided under the first rack. For convenience, the first rack is called an upper rack and the second rack 193 is called a lower rack.

The upper rack 191 and the lower rack 193 are configured to be pulled out of the tub 11 when the door 16 opens the washing space. A rail may be provided in an inner circumferential surface of the tub from a rear surface of the dishwasher to a front surface where the door 16 is provided. Wheels may be further provided in the upper and lower racks to support the racks.

The spray arm provided in the dishwasher may further include a lower arm 9 provided in the tub 11 and configured to wash the washing objects placed on the lower rack 193, an upper arm 5 provided in the tub to wash the washing objects placed on the upper rack 191 and a top nozzle 4 provided over the upper arm 5 to supply washing water to the upper rack 191 and the lower rack 193. The lower arm 9, the upper arm 5 and the top nozzle 4 are provided with the washing water via a pump and a supply path 2.

The supply path 2 includes a first supply path 21 connected to the lower arm 9 via an arm holder 17 provided in the cover 15, a second supply path 23 connected to the top nozzle 4 and the upper arm 5 and a supply-path switch/change valve 25 configured to selectively open and close the supply paths 21 and 23.

A water supply pump 18 may include a housing 81 in which an impeller 186 is provided, an inlet 183 configured to connect the housing 181 to the sump 13, an outlet 182 configured to connect the housing 181 to the supply-path change valve 25 and a motor 187 provided outside the housing 181 to rotate the motor 187.

When the impeller 186 is rotated by the motor 187 provided with the electric power, the washing water supplied to the housing 181 from the sump 13 flows to the supply-path change valve 25 via outlet unit 182. The water supplied to the supply-path change valve 25 then flows to the spray arms 5 and 9 or the top nozzle 4 along the supply paths 21 and 23 opened by the supply-path change valve 25.

The supply-path change valve 25 may be controlled to open the supply paths 23 and 23 sequentially or simultaneously. The supply-path change valve 25 may be allowable to have diverse structures to realize the function mentioned above.

The dishwasher 100 may include a tower path 3 extended toward the upper rack 191, detachably coupled to the lower rack 193, and a tower detachable unit 33 movable from the lower arm 9 according to the pressure of the water held in the lower arm 9 to be connected to the tower path 3 (so as to supply washing water to the tower path 3.

Figure 2:
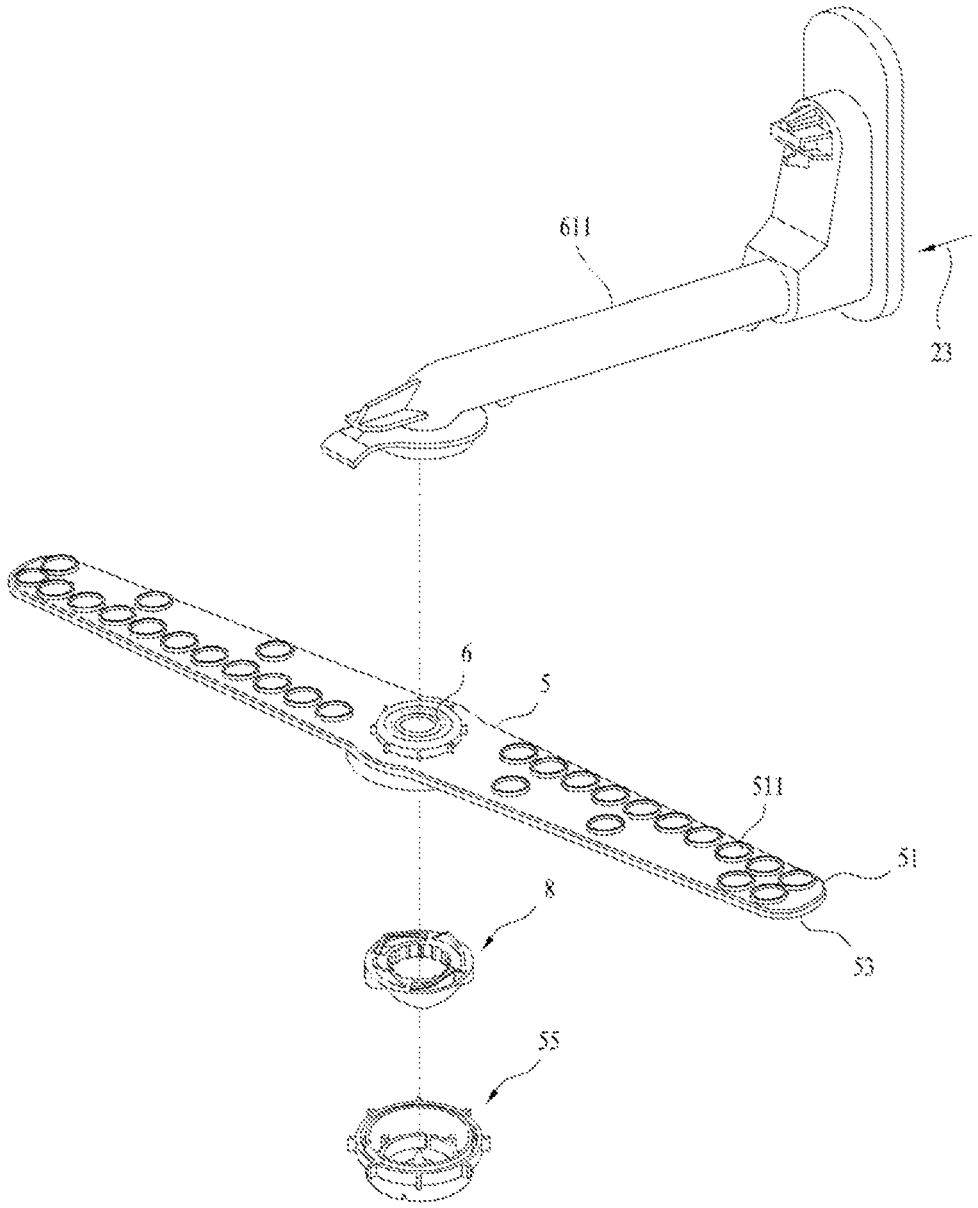
FIG. 2 is a diagram illustrating a perspective diagram illustrating an assembling process of a supply channel, a spray arm, a path change unit and a chamber.
Figure 3:
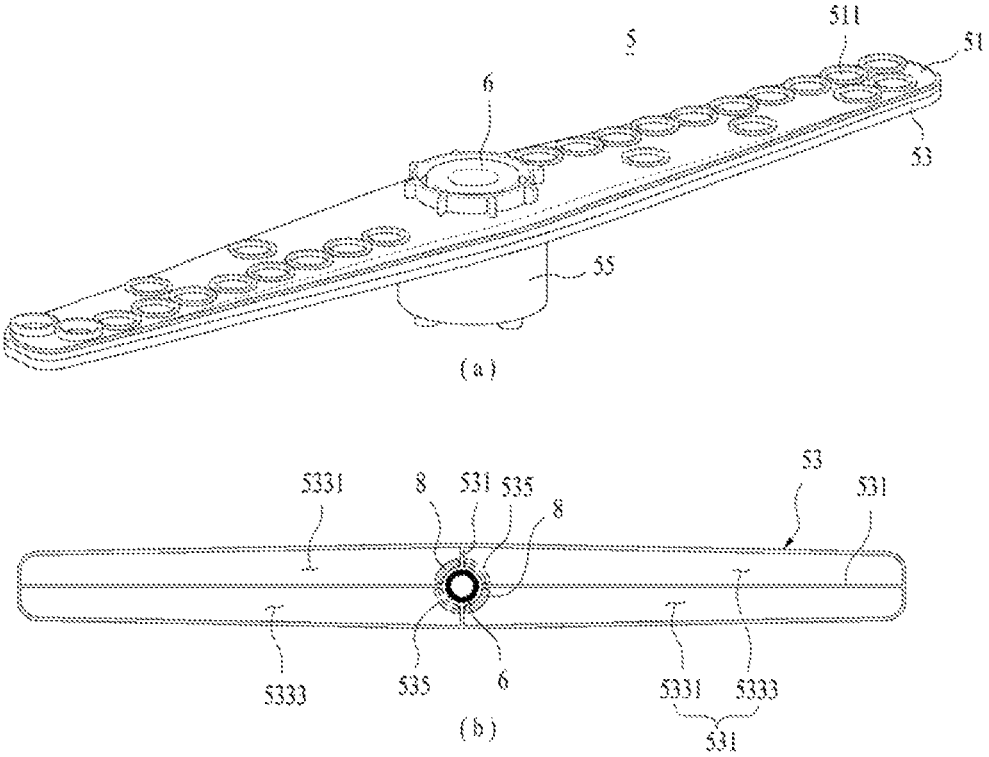
FIG. 3 is a perspective diagram of the spray arm.
Figure 4:
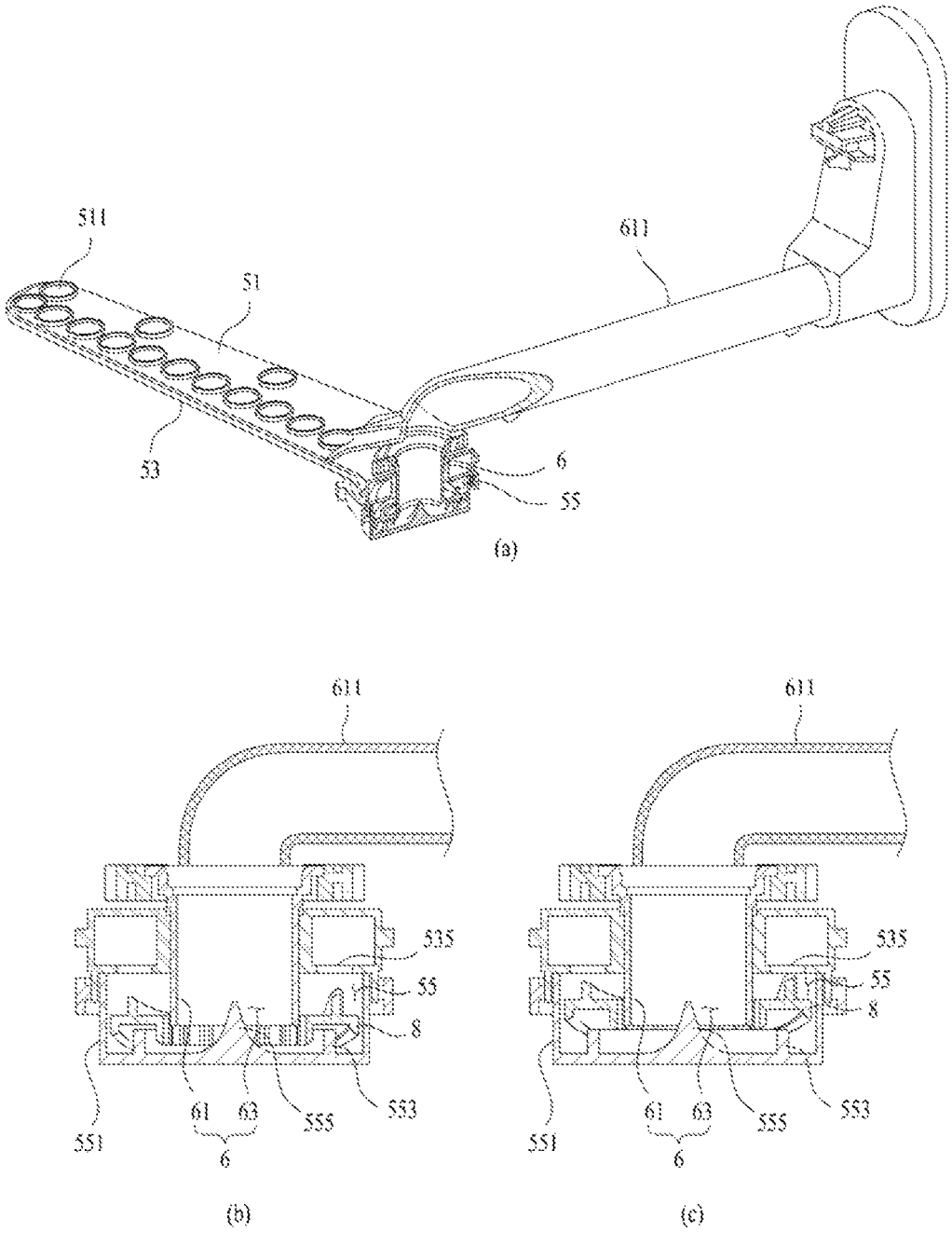
FIG. 4 is a diagram illustrating a coupling structure of the supply channel, the spray arm, the path change unit and the chamber.

FIG. 2 is a diagram illustrating a perspective diagram illustrating an assembling process of a supply channel, a spray arm, a path change unit and a chamber. FIG. 3 is a perspective diagram of the spray arm. FIG. 4 is a diagram illustrating a coupling structure of the supply channel, the spray arm, the path change unit and the chamber.

The dishwasher includes a plurality of channels configured to flow washing water therethrough, and a chamber 55 in communication with the plurality of the channels and the spray arm 5 having a spray hole 511 configured to spray the washing water supplied to the plurality of the channels toward the washing objects.

The spray arm 5 includes an upper body 51 and a lower body 53. The spray arm 5 further includes a channel guider 6 in communication with the chamber 55, penetrating the spray arm 5. The channel guider 6 is connected to the second supply path 23 via a detachable tube 611 to supply the washing water to the chamber 55.

The chamber 55 includes a path change unit 8 rotatably provided therein. The path change unit 8 is rotated a preset angle by the pressure of the water supplied to the chamber 55 and it opens predetermined channels of the spray arm 5.

The structure of the spray arm 5 and the process of the washing water supply to the spray arm 5 performed by the path change unit 8 will be described in detail. As shown in FIG. 3, the spray arm 5 includes the upper body 51 having a spray hole 511; the plurality of channels 531 provided under the upper body 51 to allow the washing water to flow therethrough separately; the lower body 53 provided under the upper body 51; and the chamber 55 provided under the lower body 53, in communication with the plurality of the channels.

The lower body 53 includes a partition wall 531 to partition off the internal space thereof into a first channel 5331 and a second channel 5333. The lower body 53 includes chamber communication holes 535 to allow the channels to communicate with the chamber 55, respectively.

In this instance, each of the upper and lower bodies 51 and 53 may further include a path guide penetrating hole to pass the path guider 6 therethrough. The chamber communication hole 535 may be provided along an outer circumferential surface of the path guider penetrating hole.

The spray hole 511 may be configured to spray the washing water along a vertical direction with respect to a top surface of the upper body 51 and an angle of the washing water sprayed via the spray hole 511 may be an acute angle with respect the top surface of the upper body 51.

When the washing water is sprayed via the spray hole 511 at the acute angle with respect to the top surface of the upper body 51, a repulsive force is generated. Accordingly, in case the spray arm 5 is rotatably provided with respect to the detachable tube 611, the spray arm 5 may be rotatable with no auxiliary driving mechanism and washing efficiency may be enhanced.

The path change unit or switch 8 may be configured to rotate and reciprocate linearly along a vertical direction in the chamber. The path change unit 8 may open some of the chamber communication holes 535. The chamber communication hole 535 are provided in a lower portion of the lower body 53 provided in the spray arm 5 to define a washing water flow space. As shown in FIG. 4, the chamber 55 includes a chamber body 551 extended from the lower body 53 downwardly to locate the chamber communication holes 535 in the chamber 55. The chamber 55 further includes a washing water storage portion 553 to store the washing water supplied to the chamber 55 via the path guider 6 for a preset time period so that the path change unit 8 can be provided with a preset buoyance.

The path guider 6 is connected to the detachable tube 611 detachably coupled to the second supply path 23. One end of the path guider 6 is connected to the detachable tube 611 and the other end of the path guider 6 is located in the chamber 55. The path guider 6 includes a hollow tub 61 penetrating the upper body 51 and the lower body 53 and an outlet hole 63 configured to discharge the washing water flowing in the hollow tube 61 into the chamber 55.

A predetermined portion of the hollow tube 61 is supported by the upper body 51 of the spray arm and the other portion is extended to a preset height from a bottom surface of the chamber 55. The outlet hole 63 may be provided in an end of the other portion of the hollow tube 61.

The path change unit body 81 includes a hollow tube inserting hole 811 to insert a path change unit body in the hollow tube 61. The path change unit 8 may be raised or fallen along a height direction of the hollow tube by the pressure and buoyancy of the washing water supplied to the chamber via the outlet hole 63. As will be described hereinafter, the chamber 55 and the path changing unit 8, may comprise a valve, where the path changing unit 8 is a rotatable float to selectively open and close the communication holes 535. Hence, water from the second supply path is selectively provide to the first channel 5331 or the second channel 5333.

Figure 5:
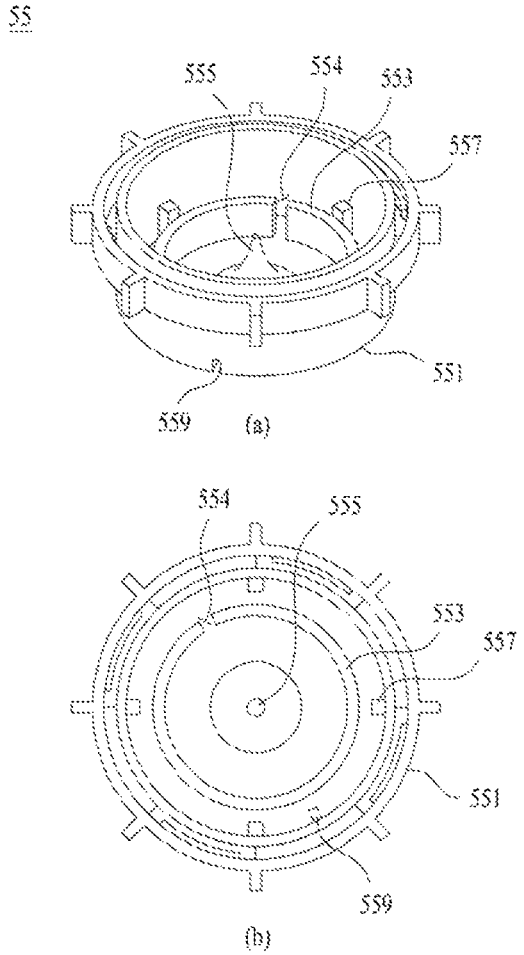
FIG. 5 includes a perspective diagram and a plane view of the chamber.
Figure 6:
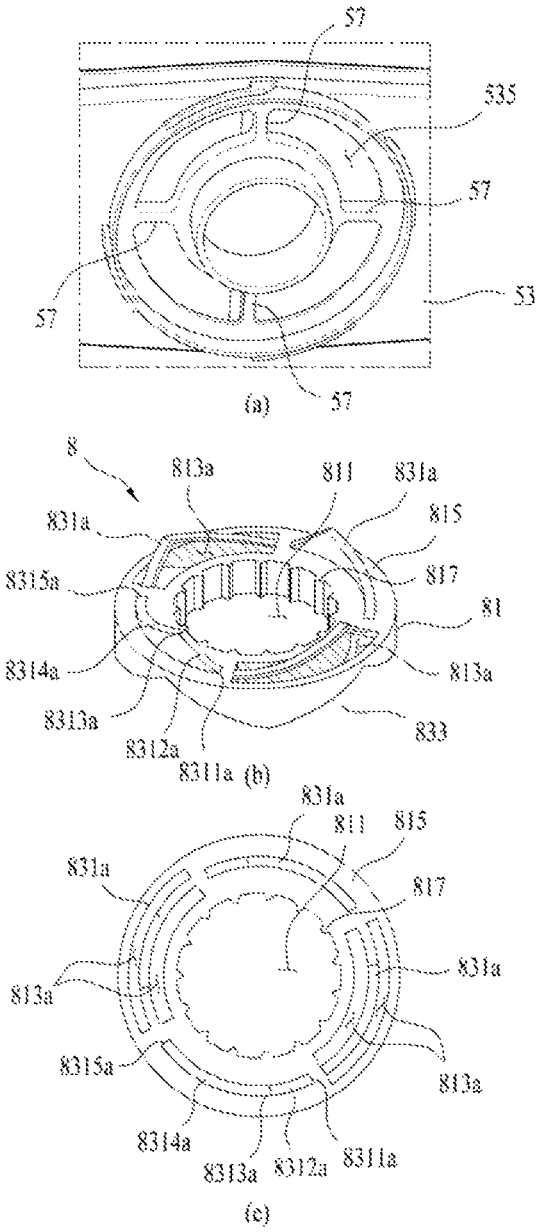
FIG. 6 includes a perspective diagram and a plane diagram of a spray arm and a path change unit in accordance with one embodiment of the present disclosure.
Figure 7:
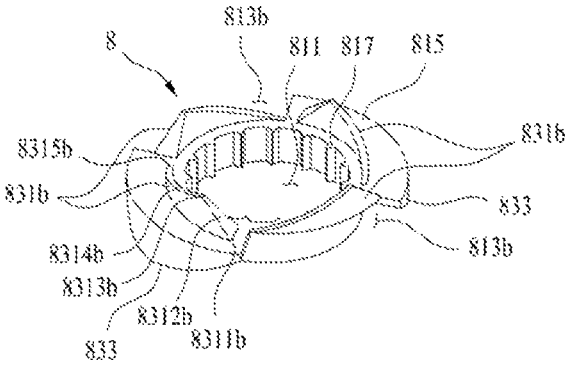
FIG. 7 is a perspective diagram of a path change unit in accordance with another embodiment of the present disclosure.
Figure 7:
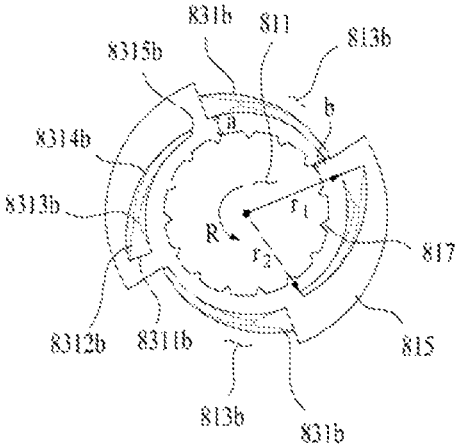

Referring to FIGS. 5 through 8, the structure of the chamber 55 and the path change unit 8 will be described in detail. FIG. 5 includes a perspective diagram and a plane view of the chamber 55 and FIG. 6 includes a perspective diagram and a plane diagram of a spray arm and a path change unit 8 in accordance with one embodiment of the present disclosure. FIG. 7 is a perspective diagram of a path change unit 8 in accordance with another embodiment of the present disclosure and FIG. 8 includes a perspective diagram and a plane diagram of a spray arm and a path change unit 8 in accordance with a further embodiment of the present disclosure.

As shown in FIG. 5, the chamber 55 further includes a chamber body 551 downwardly extended from the lower body 53 and a washing water storage portion 553 configured to store the washing water supplied to the chamber 55 for a preset time period to supply a preset buoyancy to the path change unit 8. The chamber 55 may further include an outlet guider 555 extended a preset height from the bottom surface into the hollow tube 61.

A stored water outlet hole 554 is provided in the washing water storage portion 553 to communicate with the internal space of the chamber 55 and a remaining water outlet hole 559 may be further provided in the bottom surface of the chamber 55 to drain the remaining water. The washing water storage portion 553 has a diameter which is larger than a diameter of the hollow tube 61 and smaller than a diameter of an inner circumferential surface of the chamber 55. The washing water storage portion 553 may be defined by partition walls extended a preset height from the bottom surface of the chamber 55.

The path change unit 8 is rotated by the pressure (or repulsive force) of the washing water collided with the bottom surface of the chamber 55. If the pressure of the washing water supplied to the chamber 55 is not consistent, the path change unit 8 might be raised in a state of being tilted to one side problematically. The washing water storage portion 553 is configured to solve the problem of the water pressure inconsistency in the chamber 55. The washing water drained via the outlet hole 63 is temporarily stored in the washing water storage portion 553 so than the pressure of the washing water can be consistent.

In other words, when the washing water is stored in the washing water storage portion 553 to a preset height, the path change unit 8 may be raised to the height of the hollow tube 61 by the buoyancy generated by the washing water stored in the washing storage portion 553. The washing water storage portion 553 may include a stored-water outlet hole 554 configured to prevent the washing water from remaining in the washing water storage portion 553 in case the operation of the dishwasher is stopped. The washing water storage portion is partially open to make the stored-water outlet hole 554 communicate with the internal space of the chamber 55. The outlet guider 555 may be provided in an inner bottom surface of the chamber 55 to distribute the washing water flowing in the hollow tube 61 to the internal space of the chamber 55.

One end of the detachable tube 611 is curved to be connected to the path guider 6 and an area where the flux of the washing water flowing horizontally in the detachable tube 611 is fast by the inertial force is generated in the curved portion end of the detachable tube 611. Accordingly, the distribution of the flux inside the path guider 6 connected with the detachable tube 611 is not uniform, so that the flow of the washing water into the chamber 55 could lean to one side disadvantageously. Accordingly, the pressure of the washing water applied to the lower portion of the path change unit 8 might failed to be uniform and the path change unit 8 might be raised in a state of being leaning to one side problematically, so that a problem of failure in stably supplying the washing water to the chamber 55 may arise.

To solve such a problem, the dishwasher in accordance with the present disclosure may further include an outlet guider 555 extended a preset height from the bottom surface of the chamber 55 into the hollow tube 61. The outlet guider 555 is configured to disperse the washing water flowing in the hollow tube 61 so as to supply the washing water to the chamber 55 uniformly. The outlet guider 555 is provided in a circular cone shape projected from the bottom surface of the chamber 55 and in a central portion of the hollow tube 61. When the outlet guider 555 is circular-cone-shaped, a hypotenuse of the circular cone has a preset radius curvature.

The washing water held in the pressed sump is supplied to the chamber 55 via the second supply path 23, the detachable tube 611, the hollow tube 61 and the outlet hole 63. The washing water exhausted from the hollow tube 61 may be drained via the outlet hole 63 along the guide of the outlet guider 555. The washing water exhausted from the hollow tube 61 is supplied to the chamber 55 by the outlet guider 555 uniformly and it is temporarily stored in the washing water storage portion 553, so that the pressure of the washing water may be uniform and that the path change unit 8 may be provided with the uniform buoyancy.

The chamber 55 may include a remaining water outlet hole 559 configured to prevent the washing water from remaining in the chamber when the operation of the dishwasher is stopped. The remaining water outlet hole 559 is penetrating the chamber, with a preset width determined to minimize the deterioration of the internal pressure in the chamber 55 when the washing water is supplied to the chamber 55. The remaining water outlet hole 559 may be formed in the bottom surface of the chamber to a preset height of the chamber.

Figure 8:
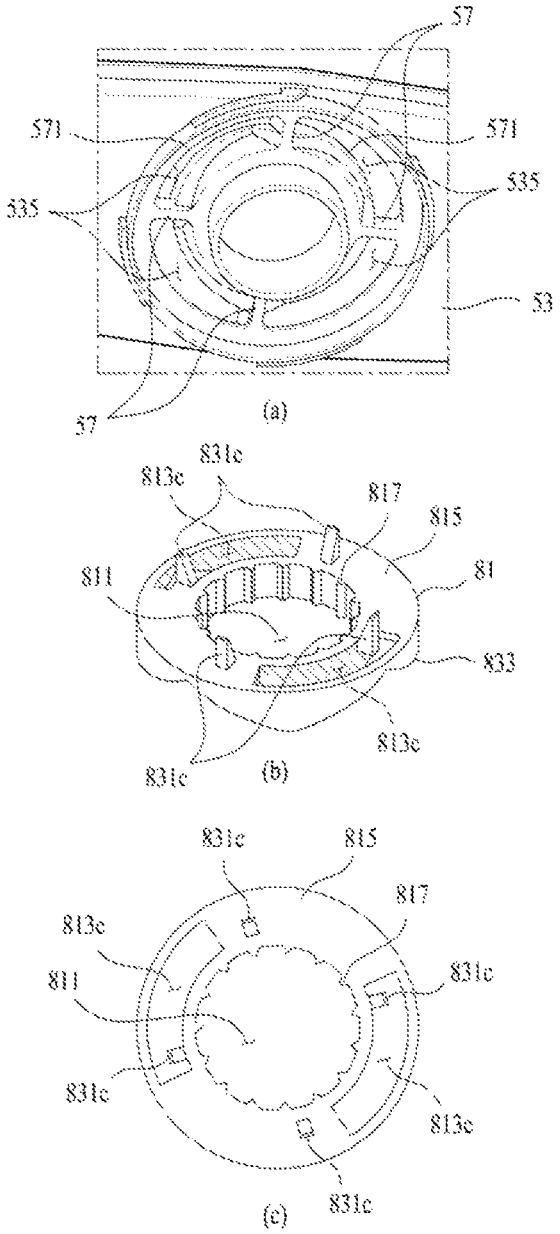
FIG. 8 includes a perspective diagram and a plane diagram of a spray arm and a path change unit in accordance with a further embodiment of the present disclosure.

Referring to FIGS. 6 through 8, the structure of the path change unit will be described in detail. The path change unit 8 includes a path change body 81 formed in a hollow shape with an open bottom and a hollow tube inserting hole 811 provided in a top surface of the path change unit to insert the hollow tube 61 therein. The path change unit body 81 may include a channel opening hole 813 configured to supply the washing water held in the chamber 55 to the chamber communication hole 535 of the spray arm 5 and a buoyancy generating portion 815 provided adjacent to the channel opening hole 813 to supply the buoyancy to the path change unit body 81.

The channel opening hole 813 penetrates the path change unit body 81. The channel opening hole 813 and the buoyancy generating portion 815 may be alternatively formed in the top surface of the path change unit body 81. The buoyancy generating portion 815 may be a plane surface horizontal to the ground to be supplied by the washing water stored in the washing water storage portion 553 provided in the chamber 55.

In accordance with one embodiment, the path change unit 8 is moved upwardly (or raised) by the buoyancy generating portion 815 when the washing water is supplied to the chamber 55 via the hollow tube 61. The path change unit 8 is moved downwardly to the bottom surface of the chamber 55 when the washing water is not supplied to the chamber 55. The path change unit 8 may be movable according to the pressure of the washing water. At this time, the path change unit 8 may be rotated a preset angle when moved upward to the top surface of the chamber 55, only to open some of the chamber communication holes 535.

In this instance, the outlet hole 63 of the path guider 6 may be provided in the path change unit body 81 (specifically, between the top surface of the path change unit body and the bottom surface of the chamber). The channel opening hole 813 may be configured to open some of the chamber communication holes 535 provided in the lower body 53.

In other words, the number of the channel opening holes is different from the number of the chamber communication holes. In FIGS. 6 through 8, it is shown that four chamber communication holes 535 spaced apart 90 degrees from each other in the lower body 53 and that two channel opening holes 813 and two buoyancy generating portions 815 are provided in the path change unit body 81. The two channel opening holes 813 are provided next to each other. As shown in FIGS. 6 through 8, they may be spaced apart 180 degrees from each other (hereinafter, the latter is applied for convenience.

The channel opening hole 813 is a hole formed in the top surface of the path change unit body 81 and a predetermined area of the top surface of the path change unit body 81 is opened to form the channel opening hole 813 or a predetermined portion of the top surface of the path change unit body 81 is extended and open to a lateral surface to form the channel opening hole 813. Accordingly, whenever the path change unit body 81 is rotated a preset angle by an upper engaging portion 57 and a lower engaging portion 557 which will be described later, the washing water can be supplied to some of the channels 5331 and 5333.

When there is no washing water in the chamber 55, the path change unit body 81 maintains the state of being supported by the lower engaging portion 557. When there is the washing water supplied to the chamber 55, the path change unit body 81 is moved to the top surface of the chamber 55 upwardly along the guide of the hollow tube 61.

Meanwhile, the path change unit body 81 is rotated a preset angle when moving in the chamber upwardly, so that the channel opening holes 813 may open some of the chamber communication holes 535. Accordingly, the washing water supplied to the chamber 55 via the second supply path 23 by the water supply pump 18 may be supplied only to a predetermined one 5531 or 5333 of the channels provided in the spray arm 5.

When the supply of the washing water to the chamber 55 is stopped, the path change unit body 81 is rotated with moving toward the bottom surface of the chamber 55. When the supply of the washing water to the chamber 55 restarts, the path change unit body 81 is moved toward the top surface of the chamber 55, with rotating to open the chamber communication holes 535 not open before.

The dishwasher in accordance with the present disclosure may supply the washing water to the plurality of the channels alternatively, so that it can diversify spraying angles of the washing water toward the washing objects to enhance the washing performance.

Meanwhile, the rotation of the path change unit body 81 may be realized in various structures. FIGS. 6 through 8 illustrate one example of the structures which is configured to rotate the path change unit body, using an upper projection 831 provided in the top surface of the path change unit body 81, an upper engaging portion 57 provided in the bottom surface of the spray arm 5, a lower projection 833 provided in the bottom surface of the path change unit body 81, a lower engaging portion 557 provided in the bottom surface of the chamber 55.

The path change unit 8 in accordance with the present disclosure may include a hollow tube inserting hole 811 having a diameter which is larger than a diameter of the hollow tube 61 to insert the path change unit 8 therein and the path change unit body 81 rotatable a preset angle by the pressure of the washing water supplied to the chamber 55. The path change unit body 81 may be rotated and moved along the height direction of the hollow tube 61 by the pressure and buoyancy of the washing water supplied to the chamber 55. The path change unit body 81 may be slidingly moved along an outer circumferential surface of the hollow tub 61 by a plurality of supporting projections 817 projected to an internal space of the hollow tube inserting hole 811.

If the hollow tube inserting hole 811 has a diameter equal to the diameter of the hollow tube 61 or it has the minimum air gap with the hollow tube 61, the path change unit body 81 may not move in case a larger force is required by the friction against with the hollow tube 61. If the hollow tube inserting hole 811 is substantially larger than the hollow tube 61, the path change unit body 81 might be moved in a state of leaning to one side or the rolling in which vertical displacement is alternatively changed when it is moved might be generated to fail to engage with the upper engaging portion 57 stably. To solve the problems, a support projection 817 is provided in the hollow tube inserting hole 811 and the support projection 817 is projected toward the hollow tube 61, so that the path change unit body 81 can move in a state of point-contacting with the hollow tub 61 and that it can receive less contact resistance enough to move stably.

The path change unit 8 may include the upper projection 831 formed in the top surface of the path change unit body 81. At this time, a predetermined number of upper projections 831 may be provided, corresponding to the number of the upper engaging portions 57.

As the upper projections 831 are corresponding to the upper engaging portions 57, an overall area where the upper projections 831 and the upper engaging portions 57 are engaging with each other may be increased. Accordingly, the problem of failure in opening the chamber communication holes 535 and the channel opening holes 813 in equal areas which might be caused by the failure in seating the path change unit body 81 in the upper engaging portions 57 can be prevented.

In this instance, the upper projections 831 may be projected from the buoyancy generating portions 815 and the channel opening holes 815 of the path change unit body 81, respectively. As they are formed in the path change unit body 81 and the buoyancy generating portions 815 alternatively arranged adjacent to each other, the number of the upper projections 831 may be corresponding to the number of the upper engaging portions 57.

The path change unit 8 in accordance with the present disclosure may include the lower projections 833 projected from the bottom surface of the path change unit body 81. The lower projections 833 may be formed in an outer circumferential surface of the path change unit 8 and they may engage with the lower engaging portions 557 provided in the bottom surface of the chamber 55, to rotate the path change unit body 81. In this instance, the number of the lower projections 833 may be corresponding to the number of the lower engaging portions 557.

Hereinafter, referring to FIG. 6, one embodiment of the path change unit 8 in accordance with the present disclosure will be described in detail. The path change unit 8 may include a channel opening hole 813*a* configured to open some of the channels according to the rotation of the path change unit body 81. The path change unit 8 may include an upper projection 831*a* slidingly engage with the upper engaging portion 57 formed in the lower portion of the spray arm 5.

The path change unit 8 may include the plurality of the chamber communication holes 535 formed in an open portion of the lower body 53 of the spray arm 5 and the plurality of the upper engaging portions 57 formed between the chamber communication holes 535. The upper engaging portion 57 may be shaped in a linear bar shape, with a preset thickness.

The number of the upper projections 831*a* in accordance with the embodiment of the present disclosure may be corresponding to the number of the upper engaging portions 57. Accordingly, the upper projections 831*a* may be projected from the top surface of the path change unit body 81 and the top of the channel opening hole 813*a*, respectively.

The upper projection 831*a* projected upward with respect to the channel opening hole 813*a* may be projected as high as the upper projection 831*a* projected from the top surface of the buoyancy generating portion 815. However, the upper projection 831*a* projected upwardly with respect to the channel opening hole may be hollow not to interfere in the flow of the washing water exhausted from the channel opening hole 813*a*.

The upper projection 831*a* may include a seating portion 8311*a* in contact with the upper engaging portion 57, a first contact portion 8313*a* where the contact with a lower surface of the upper engaging portion 57 starts and a second contact portion 8314*a* where the contact with the upper engaging portion 57 ends.

The height of the upper projection 831*a* is gradually increasing along a rotation direction of the path change unit body 81 and then decreasing. In other words, the height of the upper projection 831*a* is increasing from the first seating portion 8311*a* to the first contact portion 8313*a* and decreasing from the first contact portion 8313*a* to the first contact portion 8313*a*.

The upper projection 831*a* may include a first inclined surface 8312*a* having the height increasing from the seating portion 8311*a* to the first contact portion 8313*a* and a second inclined surface 8314*a* having the height decreasing from the first contact portion 8313*a* to the second contact portion 8315*a*. Accordingly, when the path change unit body 81 moved to the bottom surface of the chamber 55 is moved upwardly, the first contact portion 8313*a* which is a vertex of the upper projection 831*a* starts to contact with the lower surface of the upper engaging portion 57.

After that, the path change unit body 81 is rotated along the second inclined surface 8314*a* and the second contact portion 8315*a* completely contacts with the lower surface of the upper engaging portion 57. Then, the upper projection 831*a* is moved upwardly to be inserted in the chamber communication hole 535.

The seating portion 8311*a* contacts with the lateral surface of the upper engaging portion 57 and it is seated for a preset time period. As the channel opening hole 813 of the path change unit 8 and the chamber communication hole 535 provided in the spray arm 5 are open correspondingly, the washing water supplied to the chamber 55 may flow to the plurality of the channels provided in the spray arm 5.

In accordance with the embodiment of the present disclosure, the number of the upper projections 831*a* is corresponding to the number of the upper engaging portions 57, so that the contact area with the upper engaging portions 57 can be increased to facilitate the stable coupling between the upper projections and the upper engaging portions 57.

The upper projection 831*a* projected from the channel opening hole 813*a* may be configured to connect the first inclined surface 8312*a* and the second inclined surface 8314*a* in a frame type. The upper projection 831*a* may engage with the upper engaging portion 57 stably not to interfere in the outlet of the washing water exhausted via the channel opening holes 813. The upper projection 831*a* projected from the top of the channel opening hole 813*a* may prevent foreign substances from coming in the channel opening hole 813*a*.

Referring to FIG. 7, another embodiment of the path change unit 8 in accordance with the present disclosure will be described. Repeated description in the structure of the structure of the spray arm 5 mentioned above in the first embodiment is omitted in this embodiment. The path change unit 8 may include an upper projection 831*b* slidingly engaging with the upper engaging portion 57 formed in a lower portion of the spray arm 5 and a channel opening hole 813*b* configured to open some of the channels according to the rotation of the path change unit body 81.

The channel opening hole 813*b* is open, with being extended from a top surface to a lateral surface of the path change unit 8. Accordingly, the amount of the washing water exhausted via the channel opening hole 813*b* may be increased. The upper projection 831*b* may include a seating portion 8311*b* contacting with the upper engaging portion 57, a first contact portion 8313*b* where the contact with the lower surface of the upper engaging portion 57 starts and a second contact portion 8315*b* where the contact with the upper engaging portion 57 ends.

The height of the upper projection 831*b* is gradually increasing along a rotation direction of the path change unit body 81 and then decreasing. In other words, the height of the upper projection 831*b* is increasing from the seating portion 8311*b* to the first contact portion 8313*b* and decreasing from the first contact portion 8313*b* to the first contact portion 8313*b*.

Meanwhile, a distance (a) between the seating portion 8311*b* of the upper projection 831*b* and the hollow tube inserting hole 811 may be larger than a distance (b) between the second contact portion 8315*b* and the hollow tube inserting hole 811. The cross section area of the upper projection may have the width which is gradually decreasing along the rotation direction (R) of the path change unit 8.

A torque according to the rotation of the path change unit 8 may be decreased and the friction between the upper projection 831*b* and the upper engaging portion 57 may be decreased. In other words, a radius (r1) from a rotational center of the path change unit 8 to the seating portion 8311*b* is larger than a radius (r2) from the rotational center of the path change unit 8 to the second contact portion 8315*b*, only to decrease the torque of the path change unit 8 gradually toward the second contact portion 8315*b*.

The number of the upper projection 831*b* corresponds to the number of the upper engaging portions 57 and the path change unit body 81 may be then moved stably. The friction generated by the rotation may be decreased and the upper projection 831*b* may be seated in the upper engaging portion 57 easily. As the engaging distance from the rotational center of the path change unit 8 to the upper engaging portion 57 is getting reduced, the upper projection 831*b* may be seated in a proper position of the upper engaging portion 57 while rotated.

Referring to FIG. 8, a further embodiment of the path change unit 8 in accordance with the present disclosure will be described in detail. Repeated description will be omitted in this embodiment, compared with the first embodiment mentioned above. The path change unit 8 may include an upper projection 831*c* slidingly engaging with the upper engaging portion 57 formed in a lower portion of the spray arm 5 and a channel opening hole 813*c* configured to open some of the channels according to the rotation of the path change unit body 81.

The upper projection 831*c* includes a projected portion which can engage with the upper engaging portion 57. An inclined surface 571 corresponding to the first inclined surface of the upper projection, the first contact portion and the second inclined surface and the second contact portion may be formed in the upper engaging portion 57. Specifically, as shown in FIG. 8, the projected portion of the upper projection 831*c* may contact with the inclined surface 571 of the upper engaging portion 57 and then move along the inclined surface of the upper engaging portion. As only the projected portion of the upper projection 831*c* point-contacts with the upper engaging portion 57, the friction generated in the upper projection 831*c* may be reduced and the rotational force of the upper projection 831*c* may be increased.

Figure 9:
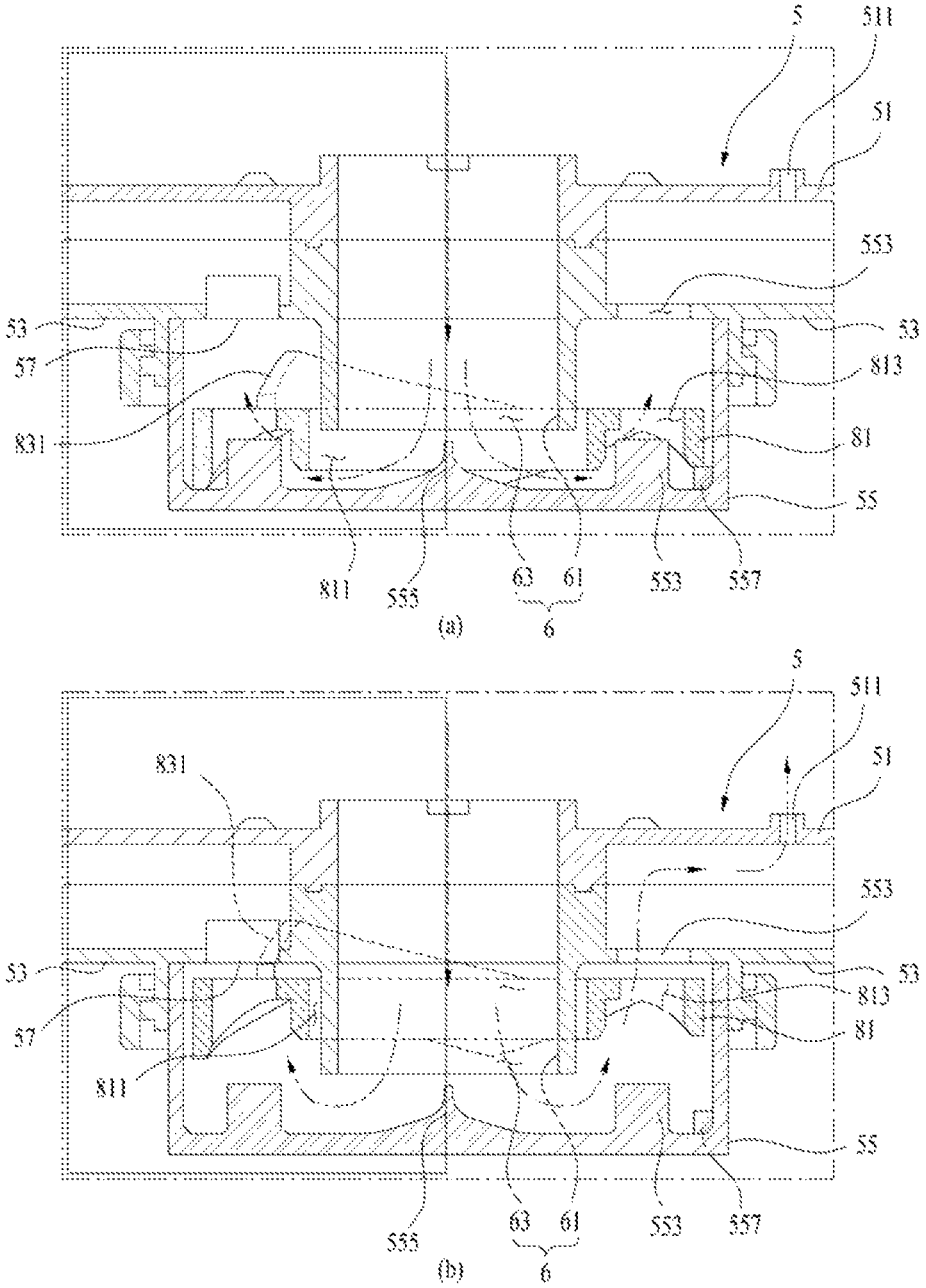
FIG. 9 is a diagram illustrating flow of washing water in a spray arm, a chamber and a path change unit.

Referring to FIG. 9, the flow of the washing water in the dishwasher will be described in accordance with the present disclosure. Washing water is supplied to the chamber 55 along the path guider 6 from the washing water supply unit (the water supply pump 18 and the second supply path 23). The washing water flowing in the hollow tube 61 is dispersed by the outlet guider 555 extended a preset height from the bottom surface of the chamber 55 into the hollow tube 61, so that the dispersed washing water may be supplied to the chamber 55 uniformly.

The washing water supplied to the chamber 55 may be stored in the washing water storage portion 553 provided in the bottom surface of the chamber 55 for a preset time period. Accordingly, the height of the washing water held in the chamber 55 may be uniform and the buoyancy needed to raise the path change unit 8 may be uniform.

Unless the washing water is supplied to the chamber 55, the path change unit 8 may be supported by the lower engaging portion 557 formed in the lower surface of the chamber 55. Once the washing water starts to be supplied to the chamber 55, the path change unit 8 may be raised along the outer circumferential surface of the hollow tube 61.

In case of the dishwasher including two channel opening holes 813 of the path change unit 8 may be provided, spaced apart a preset distance at 180 degrees from each other and four chamber communication holes 535 spaced apart a preset distance at 90 degrees in the spray arm 5, the path change unit 8 is moved and then the inclined surface of the upper projection 831 is moved along the upper engaging portion 57. At this time, the path change unit 81 may be rotated.

The path change unit body 81 of the path change unit 8 may be rotated while the path change unit 8 is moving downwardly, with the inclined surface of the lower projection 833 moving along the lower engaging portion 557. In other words, the path change unit 8 is rotated 45 degrees along the engaging of the lower projection 833 with the lower engaging portion 557. The path change unit 8 may be rotated 45 degrees in the same direction as the rotation direction when the upper projection 831 engages with the upper engaging portion 57. Accordingly, when moved upwardly once, the chamber communication holes 535 spaced apart a preset distance at 90 degrees may be sequentially opened or closed by the path change unit 8 rotated 90 degrees.

In case the channel opening holes 813 of the path change unit 8 are spaced apart a preset distance 180 degrees from each other, some of the chamber communication holes 535 which are symmetric with respect to a rotation axis of the path change unit 8 may be open.

FIG. 9 is a sectional diagram of chamber communication holes 535 arranged next to each other to make easily understood the opening and closing of the chamber communication holes 535.

The structure of the chamber 55, the path guider 6 and the path change unit 8 to spray the washing water, which is described above, may be applied even to the lower arm 9 identically. The structure may be also applied to the embodiment configured to supply the washing water not only to an upper portion of the spray arm 5 but also to a lower portion of the spray arm 6. In case the washing water is supplied to the lower portion of the spray arm 5, which is different from the embodiment above, the path guider 6 may be omitted.

As mentioned above, at least one embodiment may provide a dishwasher which may enhance washing performance.

An embodiment may provide a dishwasher which may include a spray arm configured to spray washing water, with a plurality of washing water channels.

An embodiment may also provide a dishwasher which may include a flow path change unit configured to selectively open the plurality of the channels provided in one spray arm.

An embodiment may also provide a dishwasher which may prevent the imbalanced supply of the wash water sprayed from the spray arm which might be caused by the washing water concentrate to one side when the spray arm supplies the washing water.

An embodiment may also provide a dishwasher which may prevent the imbalance of the washing water sprayed from the spray arm which might be caused by the unstable movement of the path change unit configured to selectively open the plurality of the channels.

The present disclosure may also provide a dishwasher including a tub configured to provide a space in which washing objects are held; a spray arm comprising a plurality of channels through which washing water flows, respectively, and a spray hole configured to spray the washing water supplied to the channels toward the washing objects; a chamber configured to communicate with the plurality of the channels; a washing water storage portion provided as a partition wall projected a preset height from a bottom surface of the chamber and comprising a storage space in which the washing water is stored for a preset time period; a path guider penetrating the spray arm and provided in the chamber; a washing water supply unit configured to supply the washing water to the chamber along the path guider; a path change unit rotatably provided in the chamber.

The path change unit includes a path change unit body rotatable a preset angle by the pressure of the washing water supplied to the chamber; a channel opening hole configured to open some of the channels according to the rotation of the path change unit body; a buoyancy generating portion provided adjacent to the channel opening hole and configured to raise or fall the path change unit body when provided with the buoyancy by the washing water stored in the washing water storage portion; and upper projections projected from tops of the buoyancy generating portion and the channel opening holes, respectively, to slidingly engage with an upper engaging portion formed in a lower portion of the spray arm.

The path guider may include a hollow tube extended from the spray arm to a position spaced apart a preset height from a bottom surface of the chamber, penetrating the path change unit body, and supported by the spray arm; and an outlet hole provided in one end of the hollow tube and configured to exhaust washing water to the chamber.

An outlet guider may be provided in an inner bottom surface of the chamber and in the hollow tube to distribute the washing water flowing in the hollow tube to the chamber.

A center of the outlet guider may be corresponding to a center of the hollow tube, and the outlet guider may be formed in a circular cone or cylinder shape, extended a preset height into the hollow tube from the bottom surface of the chamber.

The path change unit body may include a hollow tube inserting hole having a diameter which is larger than a diameter of the hollow tube to insert the hollow tube in the hollow tube hole, path change and the path change unit body may be raised or fallen by the pressure and buoyancy of the washing water supplied to the chamber in a direction along the height of the hollow tube.

The path change unit body may include a plurality of support projections projected into the hollow tube inserting hole to slidingly move the path change unit body along an outer circumferential surface of the hollow tube.

The number of the upper projections may be corresponding to the number of the upper engaging portions.

A buoyancy generating portion may be provided in a top surface of the path change unit body. The buoyancy generating portion may be provided with the buoyancy by the washing water storage portion, adjacent to the channel opening hole penetrating the path change unit body.

The buoyancy generating portions and the channel opening holes may be alternatively formed in the path change unit body.

The upper projections may be projected from tops of the buoyancy generating portion and the channel opening hole, respectively.

The upper projection may include a seating portion configured to engage with the upper engaging portion; a first contact portion where contact with a lower surface of the upper engaging portion starts; and a second contact portion where the contact with the upper engaging portion ends.

The upper projection may include a first inclined surface having the height which is increasing from the seating portion to the first contact portion; and a second inclined surface having the height which is decreasing from the first contact portion to the second contact portion.

A distance between the seating portion and the hollow tube inserting hole may be larger than a distance between the second contact portion and the hollow tube inserting hole.

The upper projection may be projected a preset height from a top surface of the path change unit body, and the upper engaging portion may include an upper engaging portion inclined surface configured to seat the upper projection in the upper engaging portion along a rotation direction of the path change unit body.

The washing water storage space is formed in an inner bottom surface of the chamber and it stores the washing water exhausted from the outlet hole for a preset time period to generate the uniform buoyancy used in raising the path change unit body.

The dishwasher may further include a lower engaging portion provided in an inner bottom surface of the chamber; and a lower projection provided in an outer circumferential surface of the path change unit body and configured to engage with the lower engaging portion so as to rotate the path change unit body a preset angle.

The chamber may include a washing water storage portion provided as a partition wall projected a preset height from a bottom surface of the chamber and comprising a storage space in which the washing water is stored for a preset time period.

A stored water outlet hole may be provided in the washing water storage portion and configured to communicate with an internal space of the chamber.

A remaining water outlet hole may be further provided in a bottom surface of the chamber and configured to make the chamber communicate with external air.

At least one embodiment may also provide a dishwasher including a tub configured to provide a space in which washing objects are held; a spray arm comprising a plurality of channels through which washing water flows, respectively, and a spray hole configured to spray the washing water supplied to the channels toward the washing objects; a chamber configured to communicate with the plurality of the channels; a path guider penetrating the spray arm and provided in the chamber; a washing water supply unit configured to supply the washing water to the chamber along the path guider; a path change unit provided in the chamber and rotated a preset angle by the pressure of the washing water supplied to the chamber.

The path change unit includes a path change unit body comprising a channel opening hole configured to open some of the channels according to the rotation of the path change unit body and a buoyancy generating portion alternatively provided adjacent to the channel opening hole and configured to raise the path change unit body; and upper projections projected from tops of the buoyancy generating portion and the channel opening holes, respectively, of which the number is corresponding to the number of the upper engaging portions, and configured to slidingly engage with an upper engaging portion formed in a lower portion of the spray arm.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A dishwasher comprising:

a tub configured to provide a space in which washing objects are held;

a spray arm including a plurality of channels through which washing water flows and at least one spray hole configured to spray the washing water supplied to the channels toward the washing objects;

a chamber configured to communicate with the plurality of the channels and including a chamber body;

a washing water storage portion including a storage space in which the washing water is stored for a preset time period and at least one partition wall;

a path guider penetrating the spray arm and having one end of the path guider provided in the chamber;

a washing water supply unit configured to supply the washing water to the chamber through the path guider; and a path change unit provided to be raised and lowered within the chamber to open at least one of the plurality of channels, wherein the path change unit is configured to be raised and lowered at an upper portion of the washing water storage portion, and wherein the path change unit includes:

a path change unit body provided on an outer circumferential surface of the path guider, the path change unit body being configured to rise or fall according to a water pressure of the washing water stored in the washing water storage portion; and a hollow tube inserting hole through which the path guider is inserted, wherein the at least one partition wall protrudes from a bottom surface of the chamber body and extends into the storage space, and wherein the at least one partition wall is provided between an inner circumferential surface of the chamber body and the outer circumferential surface of the path guider.

2. The dishwasher of claim 1, further comprising:

a lower engaging portion provided in an inner bottom surface of the chamber; and a lower projection provided in an outer circumferential surface of the path change unit body and configured to engage with the lower engaging portion so as to rotate the path change unit body a preset angle.

3. The dishwasher of claim 1, wherein a remaining water outlet hole is further provided in a bottom surface of the chamber and configured to make the chamber communicate with external air.

4. The dishwasher of claim 1, wherein the path change unit further includes:

a channel opening hole configured to open some of the channels according to the rotation of the path change unit body;

a buoyancy generating portion provided adjacent to the channel opening hole and configured to raise or lower the path change unit body when provided with the buoyancy by the washing water stored in the washing water storage portion; and upper projections projected from tops of the buoyancy generating portion and the channel opening holes, to slidingly engage with an upper engaging portion formed in a lower portion of the spray arm, wherein the path change unit body is provided to be rotatable a preset angle by the pressure of the washing water supplied to the chamber.

5. The dishwasher of claim 4, wherein the at least one partition wall defining the washing water storage portion is located directly beneath the channel opening hole and the buoyancy generating portion.

6. The dishwasher of claim 4, wherein the path guider comprises:

a hollow tube extended from the spray arm to a position spaced apart a preset height from the bottom surface of the chamber body, penetrating the path change unit, wherein one end of the hollow tube is supported by the spray arm; and an outlet hole provided in the other end of the hollow tube and configured to release washing water to the chamber.

7. The dishwasher of claim 6, wherein an outlet guider is provided in an inner bottom surface of the chamber and in the hollow tube to distribute the washing water flowing in the hollow tube to a space in the chamber.

8. The dishwasher of claim 7, wherein a center of the outlet guider is corresponding to a center of the hollow tube, and the outlet guider is formed in a circular cone or cylinder shape, extended a preset height into the hollow tube from the bottom surface of the chamber.

9. The dishwasher of claim 6, wherein the hollow tube is inserted through the hollow tube inserting hole.

10. The dishwasher of claim 9, wherein the path change unit body comprises a plurality of support projections projected into the hollow tube inserting hole to slidingly move the path change unit body along an outer circumferential surface of the hollow tube.

11. The dishwasher of claim 9, wherein the number of the upper projections is corresponding to the number of the upper engaging portions.

12. The dishwasher of claim 11, wherein the buoyancy generating portions and the channel opening holes are alternatively formed at the path change unit body.

13. The dishwasher of claim 11, wherein the upper projection comprises, a seating portion configured to engage with the upper engaging portion;

a first contact portion where started contacting with a lower surface of the upper engaging portion starts; and a second contact portion where terminated contacting with the upper engaging portion ends.

14. The dishwasher of claim 13, wherein the upper projection comprises:

a first inclined surface having the height which is increasing from the seating portion to the first contact portion along a rotation direction of the path change unit body; and a second inclined surface having the height which is decreasing from the first contact portion to the second contact portion along a rotation direction of the path change unit body.

15. The dishwasher of claim 13, wherein a distance between the seating portion and the hollow tube inserting hole is larger than a distance between the second contact portion and the hollow tube inserting hole.

16. The dishwasher of claim 11, wherein the upper projection is projected a preset height from a top surface of the path change unit body, and the upper engaging portion comprises an upper engaging portion inclined surface configured to seat the upper projection in the upper engaging portion along a rotation direction of the path change unit body.

17. The dishwasher of claim 6, wherein the washing water storage portion is formed in an inner bottom surface of the chamber and configured to store the washing water exhausted from the outlet hole for a preset time period to generate an uniform buoyancy which is used in raising or dropping the path change unit.

18. The dishwasher of claim 17, wherein a stored water outlet hole is provided in the washing water storage portion and configured to communicate with an internal space of the chamber.

* * * * *